United States Patent [19]

Ueda

[11] Patent Number: 4,481,393

[45] Date of Patent: Nov. 6, 1984

[54] CONTROL APPARATUS FOR HEATING APPLIANCE

[75] Inventor: Shigeki Ueda, Nara, Japan

[73] Assignee: Matsushita Electric Industrial Co., Ltd., Osaka, Japan

[21] Appl. No.: 365,267

[22] Filed: Apr. 5, 1982

[30] Foreign Application Priority Data

Apr. 16, 1981 [JP] Japan ..... 56-58233

[51] Int. Cl.[3] ..... H05B 6/68

[52] U.S. Cl. ..... 219/10.55 B; 219/492

[58] Field of Search ..... 219/10.55 B, 492, 508, 219/509, 10.55 M

[56] References Cited

U.S. PATENT DOCUMENTS

| | | | |
|---|---|---|---|
| 4,232,210 | 11/1980 | Oida et al. | 219/10.55 C |
| 4,245,296 | 1/1981 | Small et al. | 219/492 X |
| 4,309,585 | 1/1982 | Doi et al. | 219/10.55 B |
| 4,314,197 | 2/1982 | Sandler et al. | 219/10.55 B X |
| 4,330,702 | 5/1982 | Cheng | 219/492 |
| 4,334,143 | 6/1982 | Cushing | 219/492 X |
| 4,345,135 | 8/1982 | Harmon | 219/10.55 B |

FOREIGN PATENT DOCUMENTS

| | | |
|---|---|---|
| 51-9177 | 3/1976 | Japan . |
| 55-39635 | 3/1980 | Japan . |
| 55-157891 | 12/1980 | Japan . |

*Primary Examiner*—Roy N. Envall, Jr.
*Assistant Examiner*—Marvin M. Lateef

[57] ABSTRACT

A control apparatus for a heating appliance, such as a microwave oven, uses a microcomputer as its control means. A power switch for supplying power to heating means, such as a magnetron, is controlled by two switching devices, which switching devices are controlled by the microcomputer. When the user actuates a start switch, the first switching device is actuated by a control signal from the microcomputer, and thereafter, the second switching device is actuated to activate the power switch if the heating appliance is in proper operating condition. The microcomputer stops the entire heating operation whenever the heating means is not operating properly, by sensing an improper condition of the second switching device.

10 Claims, 8 Drawing Figures

80
82
84
86
88
SCN
P
T
0
ON
START SWITCH 42
t1
t2
OFF
IN (GATE OF THYRISTOR 30)
0
H (ON)
S (TRANSISTOR 32)
t3
t4
L (OFF)
τ
B
IN' (Q)
H
RELAY COIL 26
OFF
COOK START ALARM
OFF
TIME 80
82
84
86
88
SCN
P
T
0
ON
START SWITCH 42
t1
t5
OFF
IN (GATE OF THYRISTOR 30)
0
H (ON)
S (TRANSISTOR 32)
t3
t4
L (OFF)
τ
B
IN' (Q)
H
L
ON
RELAY COIL 26
OFF
ON
COOK START ALARM
OFF
TIME

CONTROL APPARATUS FOR HEATING APPLIANCE

DESCRIPTION OF THE INVENTION

The present invention relates generally to control apparatus for heating appliances, and more particularly to improved control apparatus for preventing erroneous heating mode operation of such heating appliances.

Some conventional heating appliances, such as electric ovens, gas ovens and microwave ovens, have recently employed stored program-type controllers such as microcomputers for controlling various of their operating functions. Such heating appliances, however, are constructed so that it is possible for the power supply to the heating means to be initiated contrary to the user's intention, due to, for example, a "runaway" situation caused by noise-related malfunctions of the microcomputer, or faulty operation or breakdown of program counters contained in the microcomputer.

In an attempt to eliminate such erroneous control operations, an early version of the present invention employs safety means which include first and second switch means. The first switch means is used for controlling a power switch for supplying power to the heating means, and the second switch means is used for controlling the on-and-off operation of said first switch means.

When a heating start switch is actuated, the second switch means is first rendered conductive in response to a start signal generated from a microcomputer in response to the actuation of the heating start switch. Under this condition, if the heating start switch is still actuated, the first switch means is then rendered conductive to close the power switch to supply power to the heating means. Consequently, even if the heating start switch is actuated instantaneously by accident or the start signal is erroneously produced from the microcomputer due to, for example, noise-related malfunctions, the first switch means is not rendered conductive and erroneous heating operations are not carried out.

Though the above-mentioned safety means eliminates some erroneous control operations, it is imperfect. For example, once an initial start signal is produced from the microcomputer, another start signal would be successively produced and operations other than heating operations may be erroneously executed. For example, in a microwave oven having a digital display device for displaying the preselected heating time, the heating time display may be decremented even though heating energy is not generated and no cooking is taking place. The microcomputer may operate to initiate the heating mode despite the fact that the appliance heating cavity is not being supplied with heating energy (i.e., the food is not heated at all).

The preferred embodiment of the present invention is an improvement of the above-mentioned early version, and has as its principal object the provision of an improved control apparatus for a heating appliance, which eliminates the above-mentioned drawbacks.

Another object of the present invention is to provide an improved control apparatus for a heating appliance, which does not operate erroneously when the heating start switch is actuated for a very short period of time or when a program stored-type controller such as a microcomputer produces a heating start signal erroneously due to, for example, noise-related malfunctions.

A further object of the present invention is to provide an improved control apparatus for a heating appliance having a digital heating time display device, said control apparatus inhibiting decrementing said display device until the heating means is properly producing heating energy.

Still another object of the present invention is to provide an improved control apparatus for a heating appliance having heating energy selection means, said control apparatus inhibiting the operation of such heating energy selection means until the heating mode is operating properly.

A still further object of the present invention is to provide an improved control apparatus for a heating appliance, which includes alarm means to inform the user of the start of the heating operation or of an abnormal condition.

These and other objects are accomplished by a control apparatus according to the present invention, which apparatus includes: heating means for producing heating energy; power control means for controlling the supply of power to said heating means; a start switch for starting the operation of said power control means; a circuit for controlling said power control means in response to the actuation of said start switch, said circuit including at least first control switch means responsive to the actuation of the start switch and second control switch means for causing said first control switch means to be in operable condition; and control means for controlling said circuit, said control means including first means for sensing whether said start switch is being actuated and for producing a start signal responsive to the actuation of said start switch, said start signal causing said second control switch means to operate, and second means for sensing the operation of said first control switch means in response to both the operation of the second control switch means and the actuation of the start switch, upon the lapse of a predetermined period of time after the generation of the start signal, and for stopping the generation of the start signal if said first control switch means is not operational.

In a first illustrative embodiment, the heating means includes a magnetron for producing heating energy. The power control means includes a relay for closing the power supply line to said heating means. The control circuit includes a thyristor as the first control switch means and a transistor as the second control switch means, said thyristor and transistor being connected in series and disposed between the power control means and the control means. The control means is a microcomputer.

The illustrative embodiment further includes an electronic display device for displaying heating time thereon, the control means further including third means operable in response to the sensing of the operation of said first control switch means by said second means and for decrementing the preset heating time display on the electronic display device.

In the illustrative embodiment, the power more specifically includes at least a second power control switch means to be actuated continuously and a second power control switch means to be actuated repeatedly at an interval selected from a plurality of predetermined intervals. The control circuit includes at least a third control switch means responsive to the actuation of the start switch for actuating the second power control switch means. The control means further includes means for producing a power signal in response to the sensing of the operation of the first control switch means by said second, said power control signal causing the third control switch means to operate.

In one particular embodiment, the control apparatus includes alarm means for producing an alarm signal which is used for informing the user of the start of the heating operation, or of an abnormal control condition. The alarm is executed by audible and/or digital display means.

The invention as described above produces the following benefits, among others:

The heating appliance does not operate erroneously when the start switch is actuated for a very short period of time or when the control means produces the start signal erroneously due to, for example, noise-related malfunctions;

The decrementing operation of the display device is inhibited until the heating means properly produces heating energy;

The operation of the heating energy selection means is inhibited until all heating mode operating conditions are satisfied; and The user is informed of the start of the heating operation or of an abnormal control condition, by means of an alarm.

While the novel features of the invention are set forth with particularly in the appended claims, the invention, both as to scope and content, will be better understood and appreciated, along with other objects and features thereof, from the following detailed description taken in conjunction with the accompanying drawing, in which:

Figure 1:
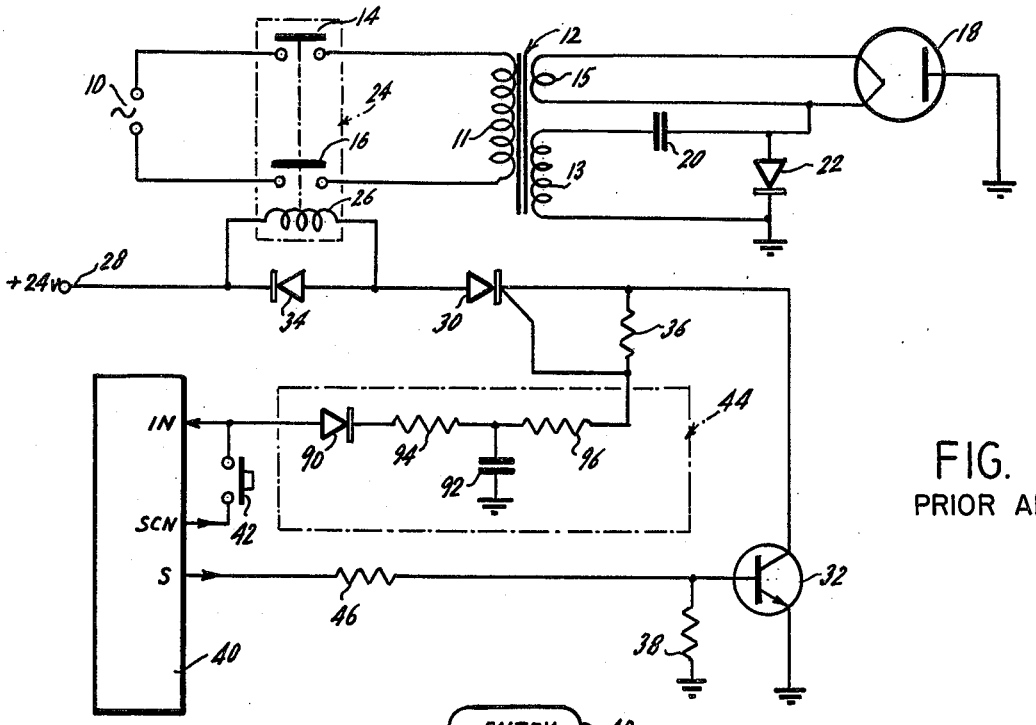
FIG. 1. PRIOR ART
FIG. 1 is a schematic circuit diagram of an early version control apparatus.

Referring to FIG. 1, there is illustrated a control apparatus for a conventional microwave oven which control apparatus employs a microcomputer as a controller and which embodies the early version of the present invention. Commercial A.C. power source 10 is supplied across primary winding 11 of transformer 12 via relay switches 14, 16 which coact as a power switch. Main secondary winding 13 of transformer 12 is connected at one end to the filament of magnetron 18 via capacitor 20 and at the other end to ground. The junction of the filament of magnetron 18 and capacitor 20 is connected to ground via diode 22. Sub-secondary winding 15 of transformer 12 is connected across the filament of magnetron 18. The anode of magnetron 18 is connected to ground.

Relay 24 includes relay switches 14, 16 which are driven by relay coil 26. For example, when relay coil 26 is energized, relay switches 14, 16 are rendered conductive to supply A.C. voltage from A.C. power source 10 to magnetron 18; and when relay coil 26 is de-energized, relay switches 14, 16 are rendered non-conductive to cut-off the supply of A.C. voltage to magnetron 18. Relay coil 26 is connected at one end to D.C. power supply terminal 28 and at the other end to ground via a series circuit consisting of a first control switch means, thyristor 30 and a second control switch means, NPN transistor 32. Relay coil 26 is connected in parallel with diode 34 and is used for protecting against excess current flow through relay coil 26. Resistor 36 is connected between the cathode and gate of thyristor 30. Resistor 38 is connected between the base of transistor 32 and ground. Thyristor 30 and transistor 32 form a circuit for controlling the supply of power to relay coil 26.

This circuit is controlled by microcomputer 40, for example, a TI Model 1670. Microcomputer 40 has at least three terminals: input terminal IN, scanning signal output terminal SCN and cooking mode start signal output terminal S. Scanning signal output terminal SCN is coupled via momentary cooking start switch 42 to input terminal IN and via cooking start switch 42 and delay circuit 44 to the gate of thyristor 30. Start signal output terminal S is coupled to the base of transistor 32 via resistor 46.

Figure 3:
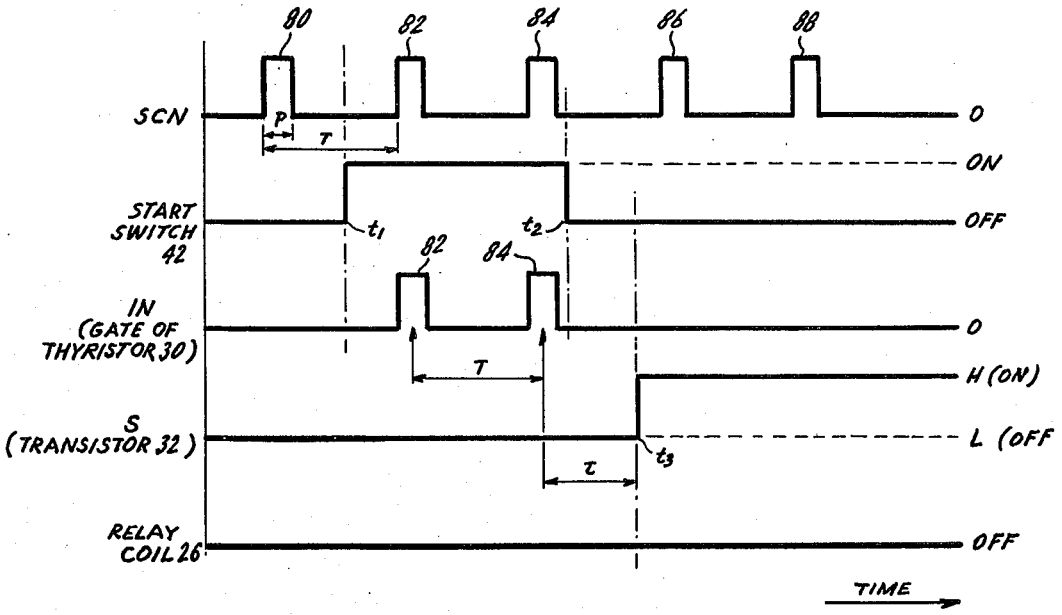
PRIOR ART FIG. 3.
FIGS. 3 and 4 are timing diagrams for explaining the operation of the control apparatus of FIG. 1.

The principal operation of the control apparatus of FIG. 1 will now be described, initially omitting discussion of delay circuit 44 (by assuming that input terminal IN is connected directly to the gate of thyristor 30) for ease of explanation. The scanning signal from terminal SCN comprises a plurality of pulses which are produced periodically at a constant period as shown in FIG. 3. The scanning signal is supplied to input terminal IN and the gate of thyristor 30 through the cooking start switch 42 while cooking start switch 42 is actuated. After it receives the scanning signal, microcomputer 40 senses whether at least two successive pulses of the scanning signal have been received. This sensing of the second pulse is done for the purpose of preventing erroneous operation. After it senses that two scanning signal pulses have been received, microcomputer 40 senses certain various oven operation conditions, namely whether the oven door has been closed, and whether the desired heating time has been set. If the results of these sensings are all positive, microcomputer 40 produces a continuous high-level start signal from the terminal S as shown in FIG. 3, which start signal is supplied to the base of transistor 32 via resistor 46 to make transistor 32 conductive. While transistor 32 is conductive, thyristor 30 will be rendered conductive whenever it is triggered by the scanning signal, so long as start switch 42 is actuated to supply scanning signals to the gate of thyristor 30. As a result, relay coil 26 is energized to make the relay switches 14, 16 conductive for supplying power to magnetron 18, and then magnetron 18 produces microwave energy for heating.

Figure 2:
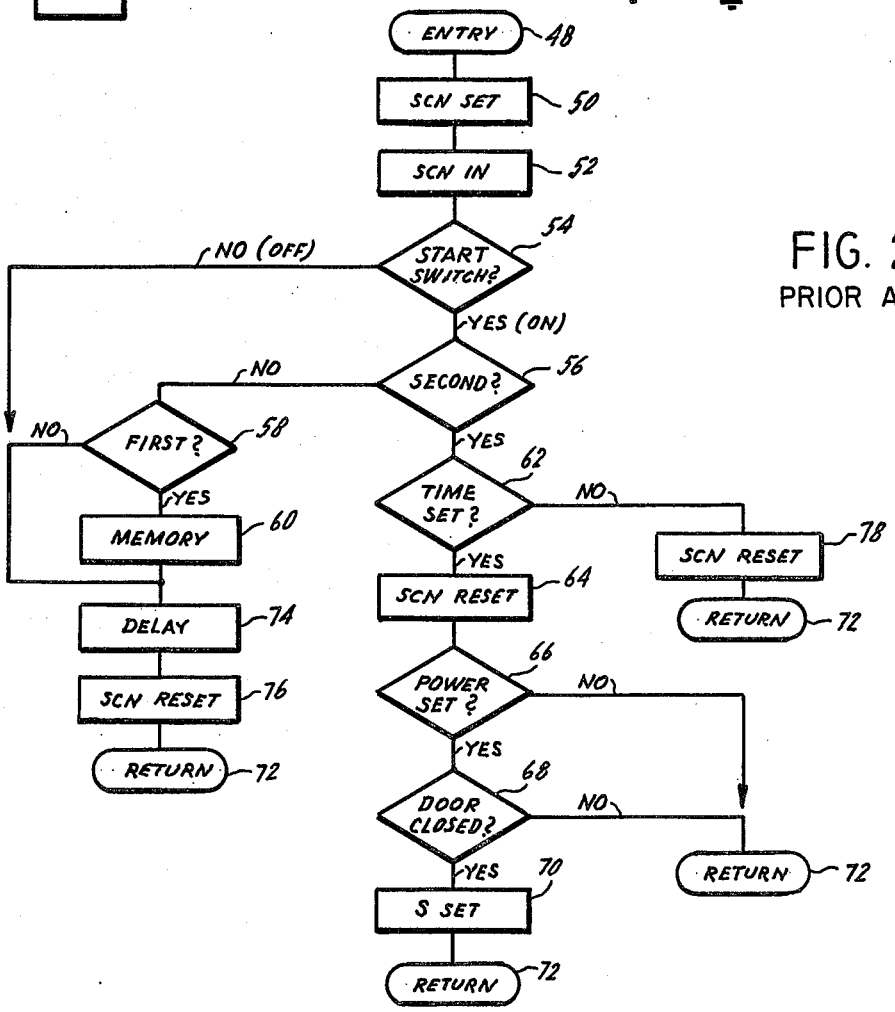
FIG. 2. PRIOR ART
FIG. 2 is a flow chart showing the operation of the microcomputer used in FIG. 1.

A more detailed explanation of the above-mentioned operation will be detailed by reference to FIG. 2. FIG. 2 shows a flow chart of one of the sub-routines programmed into microcomputer 40. This sub-routine is used at an initial stage of cooking operation. Microcomputer 40 is programmed with a main routine and a plurality of sub-routines, each controlled by the main routine. The sub-routine of FIG. 2 may be executed periodically by an instruction from the main routine.

At entry stage 48, the sub-routine of FIG. 2 begins. At next stage 50, microcomputer 40 starts to produce the scanning signal from the terminal SCN. At stage 52, if cooking start switch 42 is actuated, the scanning signal is transferred to input terminal IN of microcomputer 40 through cooking start switch 42. At stage 54, microcomputer 40 senses whether cooking start switch 42 remains actuated. If the answer is "Yes", at stage 56, microcomputer 40 senses whether the present input pulse of the scanning signal is the second one in a sequence. If the present input pulse is the first one in a sequence, the answer is "No" and this condition is sensed at stage 58 and is stored in a memory circuit of microcomputer 40, at stage 60.

If the present input pulse is the second in a sequence, the answer at stage 56 is "Yes" and microcomputer 40 senses whether the desired heating time has been set, at stage 62. If the answer is "Yes", microcomputer 40 stops the scanning signal, at stage 64, and senses whether any microwave power select switch has been actuated, at stage 66. If the answer is "Yes", microcomputer 40 senses whether the over door has been closed or not, at stage 68. If the answer is "Yes", microcomputer 40 generates a cooking start signal from terminal S, at stage 70. After the cooking start signal is produced, microcomputer 40 starts operation of the heating mode and returns control to the main routine, at return stage 72.

The transistor 32 is rendered conductive by the cooking start signal. At this time, if cooking start switch 42 is still actuated, thyristor 30 is rendered conductive and relay 24 thereby operates to supply power to magnetron 18 to generate microwave energy to the oven.

If the answer is "No" at either of stages 54 or 58, the scanning signal is stopped, at stage 76, and after a time delay (at delay stage 74), return stage 72 is executed. If the answer is "No" at stage 62, the scanning signal is stopped, at stage 78, and return stage 72 is executed. If the answer is "No" at either of stages 66 or 68, return stage 72 is executed promptly. If only a first pulse is received by microcomputer 40, stages 74, 76 and 72 are sequentially executed, after memory stage 60.

The above-mentioned control apparatus, however, has some significant drawbacks. For example, if cooking start switch 42 is actuated for only a very short period of time, the cooking start signal is produced from terminal S of microcomputer 40, but magnetron 18 will not operate, for reasons which will be described below. But, as long as a continuous start signal is produced, microcomputer 40 operates to proceed with the heating mode of the oven. In this case, if the oven has a digital heating time display device and the heating time has been preset, the time display will be successively decremented, despite the fact that no heating energy has been generated by magnetron 18. This phenomenon gives the user erroneous information that the oven is carrying out its heating function properly. This phenomenon takes place due to the time difference between the actual production of the cooking start signal (at stage 70) and the time when microcomputer 40 senses that cooking start switch 42 is still being actuated (after stage 70).

The phenomenon will be further explained by reference to FIG. 3. As stated above, the scanning signal from terminal SCN comprises a plurality of pulses which are produced periodically at a constant period. For example, each scanning pulse may have a width p of 1 msec and be produced periodically once in a period T of 10 msec. As a matter of convenience and for explanation purposes, these pulses are identified by the reference numerals 80, 82, 84, 86, 88 as shown in FIG. 3. If cooking start switch 42 is actuated for a short period of time at time $t_1$ and is returned to its initial cut-off condition at time $t_2$, two successive scanning pulses 82, 84 are supplied to input terminal IN of microcomputer 40 and to the gate of thyristor 30. As stated earlier, microcomputer 40 does not carry out its sensing operation at stages 62–68 until second scanning pulse 84 is received. After the reception of second scanning pulse 84, microcomputer 40 recognizes that cooking start switch 42 has been actuated and senses, for example, whether the oven door has been closed and whether heating time has been preset, as described above. If these sensing results are all positive, microcomputer 40 produces the start signal from terminal S at time $t_3$ (a period of t after the center of second scanning pulse 84), which start signal makes transistor 32 immediately conductive. By this operation of transistor 32, thyristor 30 is brought into operable condition since the cathode of thyristor 30 is connected to ground. At this time, however, scanning pulses to actuate thyristor 30 have already been stopped due to cooking start switch 42 having been opened. Therefore, thyristor 30 is not rendered conductive, nor is relay coil 26 energized to close relay switches 14, 16. Microcomputer 40, however, continues producing the start signal and executes the oven mode heating operation including decrementing of the heating time display, but without the generation of microwave energy.

Figure 4:
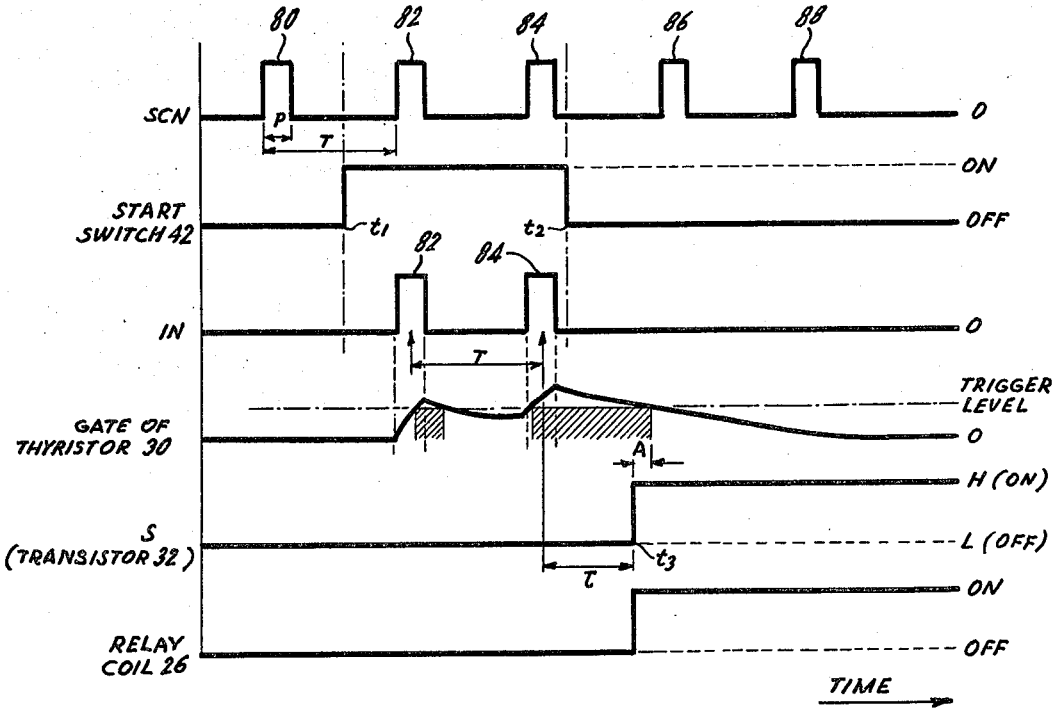
PRIOR ART FIG. 4.

To avoid the above-mentioned erroneous operation, the following solution was attempted. A delay circuit 44 is disposed between input terminal IN and the gate of thyristor 30 as shown in FIG. 1. Delay circuit 44 is well known to those skilled in the art and comprises diode 90, capacitor 92 and two resistors 94, 96. Delay circuit 44 is used for delaying scanning pulses from terminal SCN to be supplied to the gate of thyristor 30 and, taking the time t (FIG. 3) into consideration, has been designated to continue the presence of scanning pulses for a significantly long period of time after cooking start switch 42 has been opened. The operation of delay circuit 44 will be described by reference to FIG. 4. As described above (FIG. 3), if cooking start switch 42 is actuated for a short period of time, from $t_1$ to $t_2$, two scanning pulses 82, 84 are supplied to input terminal IN of microcomputer 40. The selected scanning pulses 82, 84 are also supplied to the gate of thyristor 30 through delay circuit 44. Delay circuit 44 converts this pulse wave into a saw-tooth wave as shown in FIG. 4. During the period while the level of such saw-tooth wave exceeds the trigger level of thyristor 30 (the cross-hatched area of FIG. 4), thyristor 30 is in its operative or triggered condition. When transistor 32 is rendered conductive at time $t_3$, thyristor 30 is in its operative condition for time period A causing thyristor 30 to be rendered conductive and thus, relay coil 26 to be energized to supply power to magnetron 18. In this case, power is supplied to magnetron 18 even if cooking start switch 42 is actuated instantaneously as shown in FIGS. 3 and 4.

Though the above-described use of delay circuit 44 provides one solution to the above-discussed phenonmenon, it has an operational difficulty in that the range of the delay time period is very limited. Unless the delay time is substantially shorter than the period T, delay circuit 44 often will not produce output of a high enough level to exceed the trigger level of thyristor 30, due to incomplete charging of capacitor 92, and will fail to turn on thyristor 30 given the conductive condition of transistor 32 created by the presence of the start signal. Optimum design of delay circuit 44 is difficult and troublesome adjustments must be made at the manufacturing stage to keep the delay time within the permissible range. This necessarily downgrades the reliability of the entire control apparatus.

Figure 5:
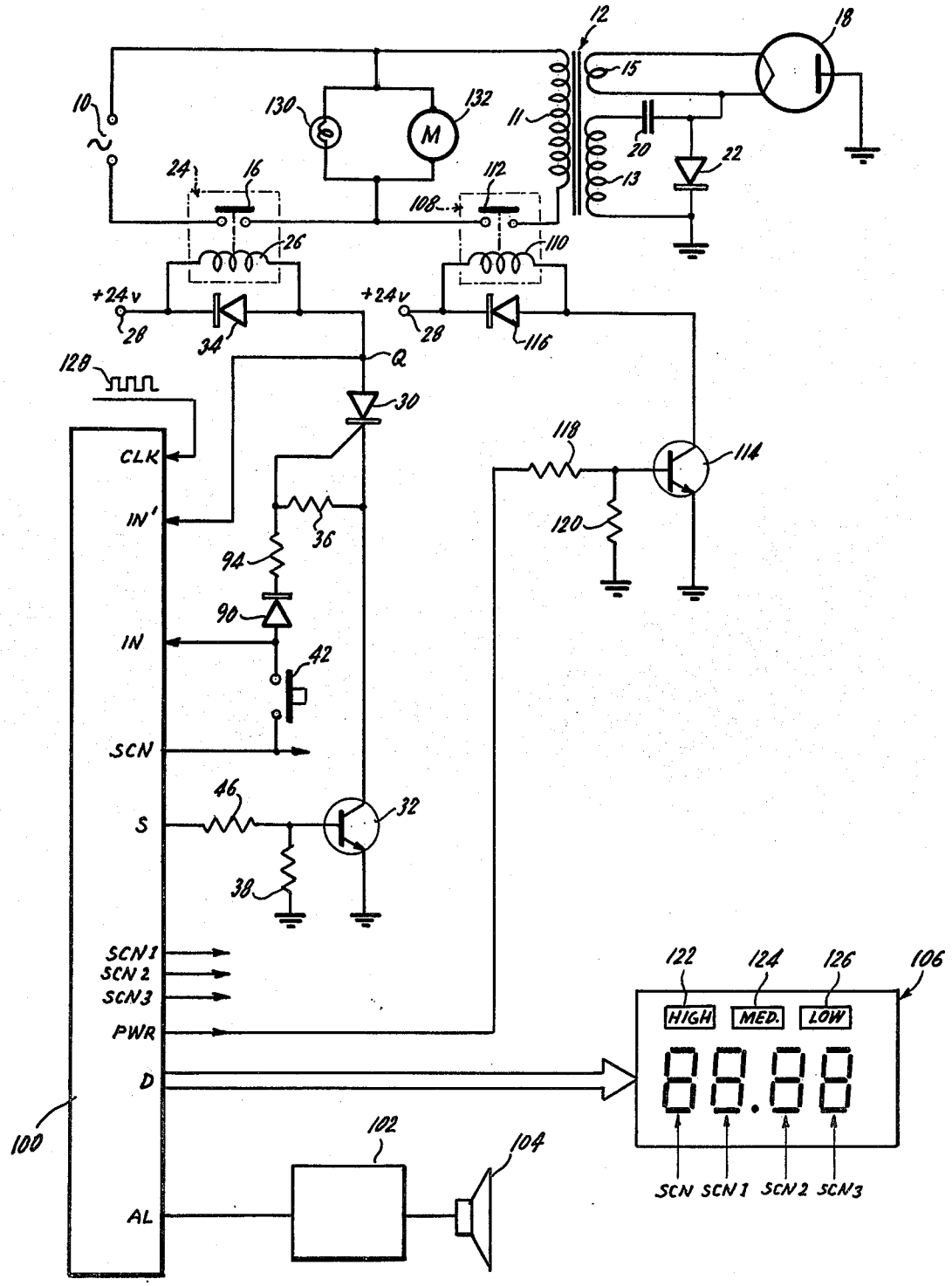
FIG. 5 is a schematic circuit diagram of a control apparatus for a microwave oven, embodying the present invention.

The present invention was intended to eliminate the above-mentioned problems and will now be described by reference to a preferred embodiment thereof as shown in FIGS. 5–8. These figures show a control apparatus for a microwave oven. The control apparatus is an improvement to the above-mentioned apparatus described in FIGS. 1–4 and thus, like reference numbers in FIGS. 5–8 denote like elements in FIGS. 1–4 and further explanation of such elements is omitted. The principal difference between the control apparatus of the preferred embodiment and the previous control apparatus shown in FIGS. 1–4 lies in the way of use of microcomputer 100, such as a TI model 1670, as shown in FIG. 5, which is used in place of microcomputer 40, and has at least two input terminals IN, IN'. A potential appearing at point Q (the anode of thyristor 30) is applied to input terminal IN' to be monitored by microcomputer 100. At a predetermined time period after the generation of the start signal from terminal S, microcomputer 100 senses whether the potential at point Q is "High" (i.e., a predetermined positive voltage) or "Low" (i.e., substantially ground), in other words, whether thyristor 30 is rendered cut-off or conductive. If microcomputer 100 recognizes that the potential is "High", it stops the generation of the start signal to terminate the entire cooking operation including, for example, decrementing the heating time display. At this time, microcomputer 100 produces an alarm signal from terminal Al and an alarm display signal (8 bit digital signal) from terminal D. Upon generation of the alarm signal, alarm circuit 102, which includes, for example, an oscillator or voice synthesizer, starts its operation and an alarm sound is generated from speaker 104 or a buzzer. Upon generation of the digital signal, heating time display device 106, such as a fluorescent display tube, starts its operation and, for example, an "FFFF" (fault) display appears on display device 106 to inform the user of an abnormal condition of the control apparatus. The signal from terminal D is applied to anode electrodes of fluorescent display tube 106, the gride electrodes of which are controlled by signal from terminals SCN, SCN1-3 of microcomputer 100. Furthermore, the microwave oven of this embodiment has heating energy selection means which changes heating energy from magnetron 18 in response to a selective actuation of power level selection switches (for example, high, medium and low). Thus, if a user wishes to heat an object using low power heating energy, a low power switch is actuated. Under this condition, if cooking start switch 42 is actuated, a low level of power is supplied to magnetron 18, and thus, magnetron 18 produces low power heating energy. The details of the heating energy selection means will be now described with reference to FIG. 5. A power control circuit includes relay 24 having power control or relay switch 16 and relay 108 including relay coil 110 and power control or relay switch 112, relay 108 being operated to vary the output of magnetron 18. Relay switch 112 is connected between relay switch 16 and primary winding 11 of transformer 12 and is closed when relay coil 110 is energized. Relay coil 110 is connected at one end to D.C. power supply terminal 28 and at the other end to ground via third control switch means, NPN transistor 114. Diode 116, connected in parallel with relay coil 110, is used for preventing excessive current flow through coil 110. Transistor 114 is connected at its base to a power control signal output terminal PWR of microcomputer 100 via resistor 118. Resistor 120 is connected between the base of transistor 114 and ground. The power control signal comprises at least three kinds of pulses which are different in frequency from one another. These pulses are selectively produced from microcomputer 100 in response to the selection of three power level selection switches (not shown), as stated above, which switches correspond to "HIGH", "MED" and "LOW" power, for producing high, medium and low power heating energy from magnetron 18, respectively.

When one of the power level selection switches is actuated, a corresponding display output is produced from display terminal D of microcomputer 100 to light one of corresponding display segments 122, 124 and 126 of display device 106. When the normal heating mode starts, microcomputer 100 supplies the power signal in an intermittent manner to transistor 114. Thus, transistor 114 is turned on and off periodically at very short time intervals and relay coil 110 is energized intermittently. As a result, magnetron 18 produces heating energy as an averaged output, which energy is changed in response to the selection of the power level selection switches. Clock pulses 128 are supplied to microcomputer 100 through clock terminal CLK and are used as a timing signal for timers, counters and other circuitry of microcomputer 100. Lamp 130 is used for lighting the inside of the cooking cavity (not shown) and motor 132 is used for driving a fan (not shown) which cools magnetron 18.

The principal operation of the control apparatus of the present invention will now be described by reference to FIGS. 6 and 7 in addition to FIG. 5.

Figure 6:
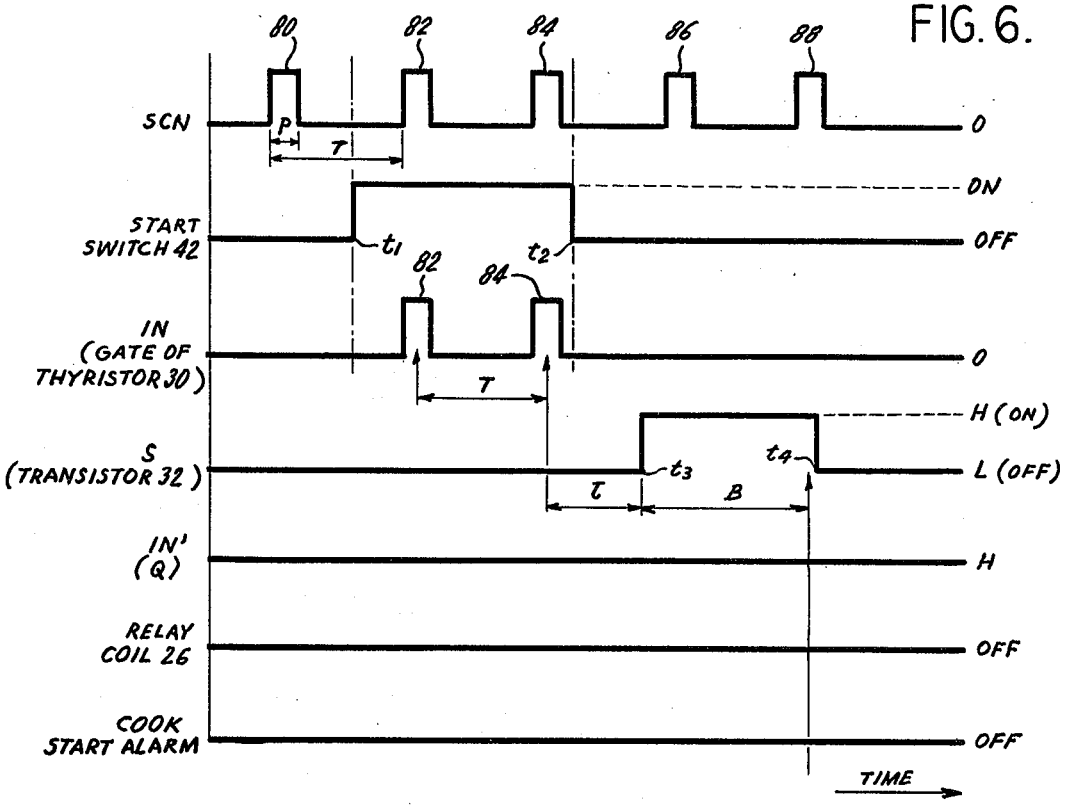
FIGS. 6 and 7 are timing diagrams for explaining the operation of the control apparatus of FIG. 5.

As is apparent from the comparison of FIGS. 3 and 6, the control apparatus of the preferred embodiment operates in substantially the same manner as the one previously described. If cooking start switch 42 is actuated for a very short period of time, from time $t_1$ to time $t_2$, scanning pulses 82, 84 are supplied to input terminal IN of microcomputer 100 through cooking start switch 42. After reception of the second scanning pulse 84, microcomputer 100 senses certain oven operating conditions, such as whether the oven door has been closed and whether heating time has been preset on display device 106. If these sensing results are all positive, microcomputer 100 produces the start signal from terminal S after a lapse of time period t at time $t_3$. The above-described sequential operations are substantially the same as those of the earlier version control apparatus explained in FIG. 3. The principal difference is that at time $t_4$ after a lapse of period B (set by a timer in microcomputer 100), microcomputer 100 checks the level (High or Low) of input terminal IN' (point Q), In FIG. 6, since thyristor 30 is in its cut-off condition at time $t_4$ and thus, the level of point Q is "High", microcomputer 100 stops the generation of the start signal from terminal S, thus, stopping the entire heating mode operation. Depending upon the level of point Q at time $t_4$, microcomputer 100 discontinues producing the start signal if the level of point Q still remains "High". In this case, clock pulses 128 (FIG. 5) at clock terminal CLK of microcomputer 100 are not counted in microcomputer 100, nor is the heating time display on digital display device 106 decremented. If the start signal stops, the heating time display remains unchanged.

Figure 7:
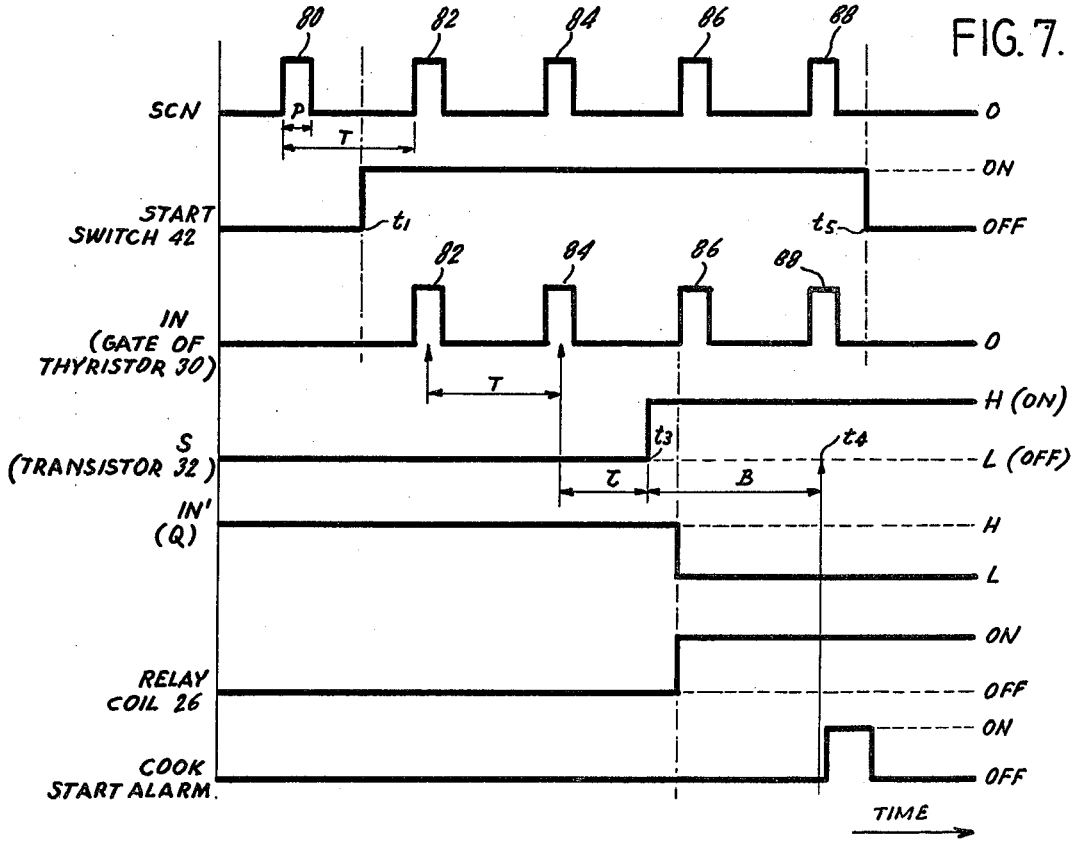

However, if cooking start switch 42 is pressed for a sufficient period of time from time $t_1$ to $t_5$, as shown in FIG. 7, thyristor 30 is rendered conductive by being triggered by pulse 86 and thus, the level at point Q is "Low" at time $t_4$. Thus, the start signal is produced continuously even after time $t_4$ and the entire heating mode operation continues without interruption.

A power control signal is not produced before the lapse of period B. At time $t_4$, if microcomputer 100 recognizes that the level of point Q is "Low", microcomputer 100 produces the power control signal from terminal PWR. If the level of point Q is still "High" at the time $t_4$, such power control signal is not produced, nor is relay switch 112 closed. This means that even if relay switch 16 is closed erroneously, magnetron 18 will not be activated when the level of point Q remains "High". Furthermore, at time $t_4$, if microcomputer 100 recognizes that the level of point Q is "Low", microcomputer 100 produces a pulse signal from alarm terminal Al and then, an audible sound is produced from speaker 104 as shown in FIG. 7 to inform the user that the oven has been initiated for cooking operation. The heating time display on digital display device 106 is counted down. If the heating time display reaches zero, the entire cooking operation stops automatically by the action of microcomputer 100.

Figure 8:
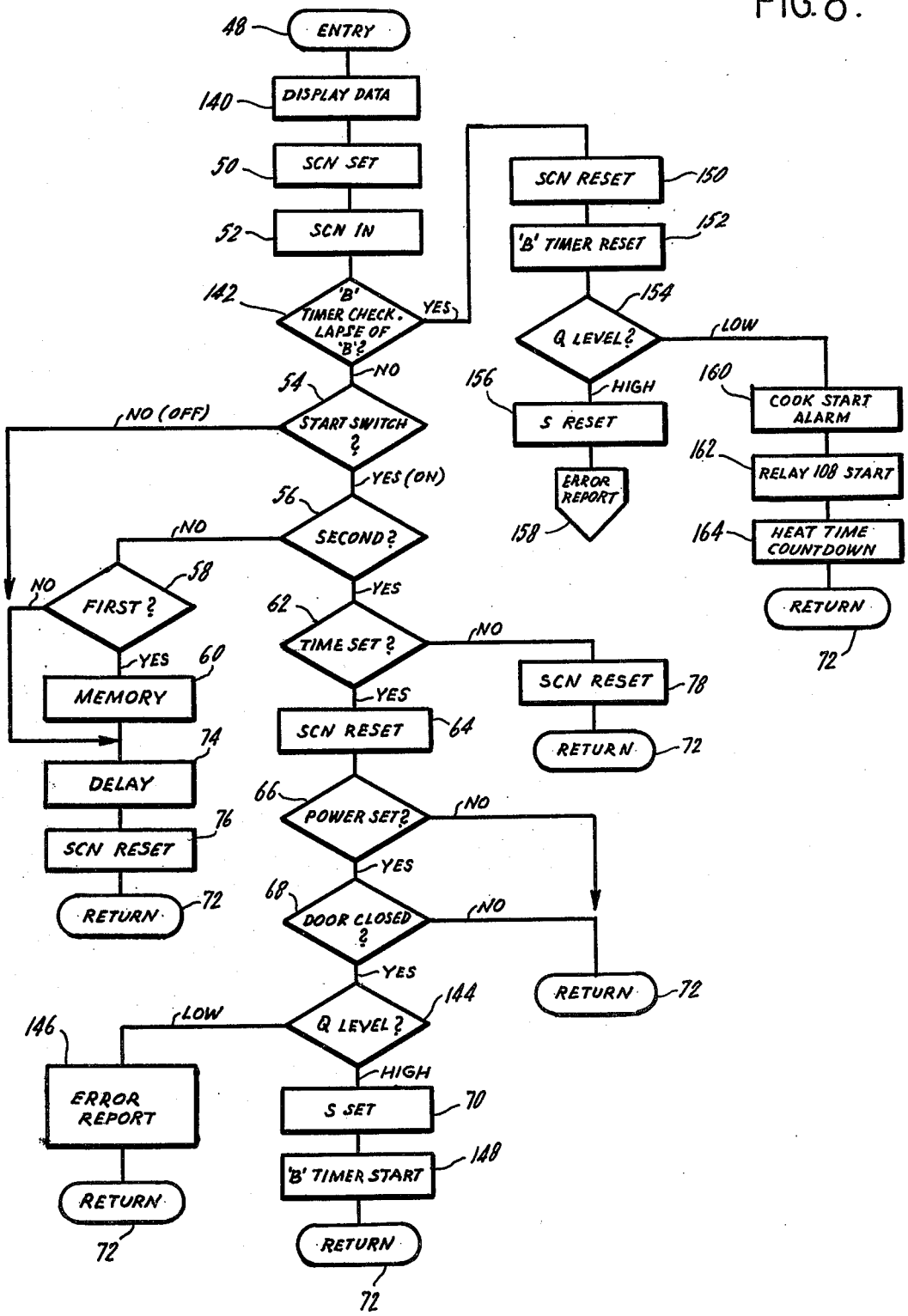
FIG. 8 is a flow chart showing the operation of the microcomputer used in the control apparatus of FIG. 5.

The above-mentioned operation will be detailed by reference to FIG. 8. FIG. 8 shows a flow chart of one of sub-routines programmed into microcomputer 100. This subroutine is based on the sub-routine of FIG. 2. Therefore, like numbers denote like stages and further explanation is omitted. After entry stage 48, microcomputer 100 produces an 8 bit digital display signal from terminal D to digital display device 106, at stage 140. Then, at stage 50, the scanning signal is produced and, at stage 52, the scanning signal is applied to input terminal IN through cooking start switch 42. At stage 142, microcomputer 100 checks and resets a timer (not shown) therein, which timer counts period B (FIGS. 6 and 7) from time $t_3$ to time $t_4$. Next, stages 54–68 are executed and microcomputer 100 senses the oven conditions after the reception of the second scanning pulse. If these sensing results are all positive, microcomputer 100 checks the level of point Q, at stage 144. If the level is "High", the start signal is produced from terminal S, at stage 70. However, if the level is "Low", error report stage 146 is executed. The fact that the level is "Low" means that the control circuit of relay 24 is in an operable condition despite the absence of the start signal and thus, is malfunctioning. In this case, as stated above, the audible alarm sound is produced from speaker 104 and "FFFF" is displayed on display device 106. At this time, if microcomputer 100 does not receive any input signal produced in response to an actuation of any external operation switch, erroneous start of the cooking operation is prevented completely and a high level of safety is obtained.

If the level of point Q is "High" at stage 144, the start signal is produced at stage 70 and then the timer which sets period "B" starts to operate, at stage 148, and the program is returned to entry stage 48 through return stage 72.

The stages 140–52 are again executed, and thereafter, at stage 142, microcomputer 100 senses whether period "B" has elapsed. If the answer is "Yes", scanning signal stops, at stage 150, and the timer for period "B" is reset at stage 152. At stage 154, microcomputer 100 senses again whether the level of point Q is "High" or "Low". If the answer is "High", microcomputer 100 stops the scanning signal at stage 156, and jumps the program to the error report stage 146 through jump stage 158, because the "High" level of point Q at time $t_4$ of FIG. 7 means that the control circuit of relay 24 is out of order. On the other hand, if the answer at stage 154 is "Low", the audible cooking start alarm is produced at stage 160, as shown in FIG. 7 and then, microcomputer 100 produces a power control signal from terminal PWR to cause relay 108 to execute on-and-off operations at stage 162, and the heating time display on display device 106 is decremented at stage 164. If the heating time reaches zero, the entire cooking operation stops, or another heating operation starts.

While relays are used for controlling the power to be supplied to magnetron 18 in the above-mentioned embodiment, electronic switches such as switching transistors could be used instead. Furthermore, the microcomputer as a control means could be replaced by solid state circuits which function in the same manner. The control apparatus can be applied to various heating appliances such as a gas oven, an electric oven and an electric furnace, instead of a microwave oven.

While a specific embodiment of the invention has been illustrated and described herein, it is realized that modifications and changes, for example, to use a switching transistor instead of a relay, and to construct a control means by solid state circuitry instead of a microcomputer, will occur to those skilled in the art. It is therefore to be understood that the appended claims are intended to cover all modifications and changes as fall within the true spirit and scope of the invention.

What is claimed is:

1. An apparatus for control of a heating appliance, comprising:

heating means for producing heating energy;

power control means for controlling the supply of power to said heating means;

a start switch actuable to energize said power control means;

a control circuit coupled to said power control means for activating said power control means to apply power to said heating means in response to the actuation of said start switch;

control means for controlling the operation of said control circuit, said control means including first means for sensing whether said start switch is actuated and for producing a start signal responsive to the actuation of said start switch, said start signal causing said control circuit to activate said power control means and to produce a control signal indicative thereof and second means for sensing the presence or absence of said control signal after the lapse of a predetermined time period to affect the operation of said power control means in accordance with the state of said control signal.

2. The apparatus according to claim 1, wherein said power control means includes a first relay for continuously closing a power supply line to said heating means and a second relay for intermittently closing the power supply line to said heating means.

3. The control apparatus according to claim 1, further comprising alarm means controlled by said control means for producing alarm information responsive to an abnormal condition of said control apparatus.

4. An apparatus for control of a heating appliance, comprising:

heating means for producing heating energy;

power control means for controlling the supply of power to said heating means;

a start switch for initiating the start of operation of said power control means;

a control circuit for controlling said power control means in response to the actuation of said start switch, said control circuit including first control switch means coupled to said power control means actuable in response to the actuation of the start switch, second control switch means connected in series with said first switch means, and third control switch means coupled to said power control means;

a microcomputer for controlling said control circuit, said microcomputer including first means for sensing whether said start switch is actuated and for producing a start signal responsive to the actuation of said start switch, said start signal causing said second control switch means to operate, second means for sensing the operation of the first control switch means and the actuation of the start switch upon the lapse of a predetermined time period after the generation of the start signal and producing in response to the operation of said first control switch means a power control signal coupled to said third control switch means for controlling the power output from said heating means.

5. The apparatus of claim 4 wherein said power control means includes a pair of power control switches coupling a power source to said heating means, said third control switch means being coupled to control the operation of one of said pair of power control switches to produce intermittant operation of said power control switches in response to said power control signal.

6. A control apparatus for a heating appliance, comprising:

heating means for producing heating energy;

power control means for controlling the supply of power to said heating means, said power control means including a pair of power control switches;

a start switch for starting the operation of said power control means;

a control circuit for controlling said power control means in response to the actuation of said start switch, said control circuit including first control switch means coupled to control the operation of one of said power control switches responsive to the actuation of the start switch, second control switch means for controlling said first switch means, and third control switch means coupled to control the operation of the other of said power control switches;

an electronic display device for displaying a present heating time thereon; and control means for controlling said control circuit and said electronic display device, said control means including first means responsive to the actuation of said start switch for producing a start signal, said start signal causing said second control switch means to operate, second means for sensing the operation of said first control switch means in response to both the operation of the second control switch means and the actuation of the start switch upon the lapse of a predetermined time period after the generation of the start signal and producing in response to the operation of said first control switch means a power control signal coupled to said third control switch means, and third means operable in response to the operation of said first control switch means by said second means for decrementing the preset heating time on the electronic display device.

7. The control apparatus according to claim 6 wherein said control means further includes alarm means for producing a digital alarm display signal to be displayed on said electronic display device when said control means senses an abnormal condition of said control apparatus.

8. A control apparatus for a heating appliance, comprising:

heating means for producing heating energy;

power control means for controlling the supply of power to said heating means, said power control means including at least first power control switch means to be actuated continuously and second power control switch means to be actuated repeatedly at an interval selected from a predetermined plurality of intervals to control the amount of power produced by said heating means;

a start switch for initiating the start of operation of said power control means;

a control circuit for controlling said power control means in response to the actuation of said start switch, said control circuit including first control switch means responsive to the actuation of the start switch and coupled to said first power control switch means for actuating said first power control switch means, second control switch means for actuating said first control switch means and third control switch means coupled to said second power control switch means or actuating said second power control switch means; and control means for controlling said control circuit, said control means including first means responsive to the actuation of said start switch for producing a start signal, said start signal causing said second control switch means to operate, second means for sensing the operation of said first control switch means in response to both the operation of said second control switch means and the actuation of the start switch upon the lapse of a predetermined time period after the generation of the start signal and for stopping the generation of the start signal if the first control switch means is not operating, and third means for producing a power control signal in response to the sensing of operation of said first control switch means by said second means, said power control signal causing said third control switch means to operate intermittently to produce intermittent operation of said second power control switch means thereby controlling the amount of power produced by said heating means.

9. The control apparatus according to claim 8 wherein said first and second power control switch means are relays having contacts coupling a source of power to said heating means.

10. A control apparatus for a microwave oven, comprising:

a magnetron circuit for producing microwave energy;

a continuously actuable first relay having at least a pair of contacts for controlling said magnetron circuit;

a second relay having at least a pair of contacts coupled to the contacts of said first relay and actuable intermittently at intervals selected from a predetermined plurality of intervals to control the amount of power produced by said magnetron;

a start switch for initiating the start of operation of said first and second relays;

a control circuit for controlling said relays in response to the actuation of said start switch, said control circuit including a thyristor coupled to said first relay and triggerable in response to the actuation of the start switch, a first transistor connected in series with said thyristor for controlling the operation of said thyristor and a second transistor for controlling the operation of said second relay; and a microcomputer for controlling said control circuit, said microcomputer including first means for sensing the actuation of said start switch and for producing a start signal responsive to the actuation of the start switch, said start signal causing said first transistor to operate, second means for sensing whether said thyristor is conductive in response to both the operation of the first transistor and the actuation of the start switch upon the lapse of a predetermined time period after the generation of the start signal and for stopping the generation of the start signal if said thyristor is non-conductive, and third means for producing a power control signal causing said second transistor to operate intermittently at selected intervals to control the operation of said second relay.

* * * * *